US007831186B2

(12) United States Patent
Obata et al.

(10) Patent No.: US 7,831,186 B2
(45) Date of Patent: Nov. 9, 2010

(54) FIXING DEVICE AND IMAGE FORMING APPARATUS

(75) Inventors: Shigeru Obata, Ibaraki (JP); Masahiro Yagi, Ibaraki (JP); Yoshihiro Fukuhata, Hyogo (JP); Shin Yamamoto, Osaka (JP); Toshio Ogiso, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 117 days.

(21) Appl. No.: 11/776,989

(22) Filed: Jul. 12, 2007

(65) Prior Publication Data

US 2008/0013993 A1 Jan. 17, 2008

(30) Foreign Application Priority Data

Jul. 12, 2006 (JP) ..... 2006-191110
Jul. 12, 2006 (JP) ..... 2006-191111
Jul. 13, 2006 (JP) ..... 2006-193194

(51) Int. Cl.
*G03G 15/20* (2006.01)

(52) U.S. Cl. ..... 399/328; 399/329; 219/216

(58) Field of Classification Search ..... 399/320, 399/328, 329, 330, 331, 333; 219/216
See application file for complete search history.

(56) References Cited

U.S. PATENT DOCUMENTS 5,543,905 A * 8/1996 Oda et al. ..... 399/328
6,597,888 B1 * 7/2003 Abe et al. ..... 399/329
6,818,591 B2 11/2004 Arai et al.
7,480,478 B2 * 1/2009 Aze et al. ..... 399/328
2003/0035660 A1 * 2/2003 Sugino et al. ..... 399/111
2005/0014645 A1 1/2005 Shimbo et al.
2005/0141932 A1 * 6/2005 Sugiyama ..... 399/328
2006/0063671 A1 3/2006 Kutami et al.
2007/0140752 A1 6/2007 Yamamoto et al. ..... 399/323
2007/0172278 A1 7/2007 Yamamoto ..... 399/323
2007/0223976 A1 9/2007 Yagi et al. ..... 399/329

FOREIGN PATENT DOCUMENTS

CN 1220117 A 6/1999
JP 03-233586 10/1991
JP 07-248696 9/1995

(Continued)

OTHER PUBLICATIONS

Chinese Office Action dated Apr. 10, 2009 with English Translation.

*Primary Examiner*—David M Gray
*Assistant Examiner*—Barnabas T Fekete
(74) *Attorney, Agent, or Firm*—Harness, Dickey & Pierce, P.L.C.

(57) ABSTRACT

A pressurizing member includes an elastic member having a uniform elastic modulus of K=EA/t, where E is a Young's modulus, A is an area of the nip portion, and t is a thickness of the elastic member in the direction of application of load. A supporting member that supports the pressurizing member has an entering portion, an exit portion, and a center portion between the entering portion and the exit portion. The thickness of the center portion in a direction of application of load is larger than thicknesses of the entering portion and the exit portion in the direction of application of load so that the supporting unit has a convex portion.

20 Claims, 17 Drawing Sheets

FOREIGN PATENT DOCUMENTS

| | | |
|---|---|---|
| JP | 08-166734 | 6/1996 |
| JP | 08-262903 | 10/1996 |
| JP | 09-251252 | 9/1997 |
| JP | 63-036283 | 2/1998 |
| JP | 11-212389 | 8/1999 |
| JP | 2001-296691 | 10/2001 |
| JP | 2002-025713 | 1/2002 |
| JP | 2002-207388 | 7/2002 |
| JP | 2004-045780 | 2/2004 |
| JP | 2005-164721 | 6/2005 |

* cited by examiner

| HARDNESS | LOAD | NIP WIDTH | PAD/HOLDER SHAPE | SHEET RELEASABILITY | REFERENCE |
|---|---|---|---|---|---|
| Hs (JIS-A) | kgf | mm | mm | | |
| 8 | 40 | 7 |  | UNFAVORABLE | CONVENTIONAL EXAMPLE |
| 8 | 40 | 7 |  | FAVORABLE | FIG. 2, 9 |
| 8 | 40 | 7 |  | FAVORABLE | FIG. 3, 10 |
| 8 | 40 | 7 |  | FAVORABLE | FIG. 4, 11 |
| 8 | 40 | 7 |  | FAVORABLE | FIG. 6, 12 |

FIG. 16A

FIG. 16 | FIG. 16A | FIG. 16B

| Lot. | CENTRAL PORTION A | | | | |
|---|---|---|---|---|---|
| | Hs (JIS-A) | VOLUME RATIO | AVERAGE THICKNESS [mm] | COATING-AGENT THICKNESS [pm] | Hs (JIS-A) WITH COATING-AGENT |
| 1 | 8 | 85 | 2 | 0 | 8 |
| 2 | 7 | 90 | 2 | 0 | 7 |
| 3 | 8 | 80 | 2 | 0 | 8 |
| 4 | 8 | 85 | 1.8 | 50 | 12 |
| 5 | 8 | 95 | 2 | 30 | 11 |
| 6 | 8 | 90 | 2 | 0 | 8 |
| 7 | 7 | 70 | 1.9 | 0 | 7 |
| 8 | 7 | 85 | 2 | 0 | 7 |
| 9 | 8 | 90 | 2 | 50 | 9 |
| 10 | 8 | 85 | 2 | 100 | 11 |

FIG. 16B

| EDGE PORTION B | | | | | UPON NIP PORTION MEASUREMENT | | |
|---|---|---|---|---|---|---|---|
| Hs (JIS-A) | VOLUME RATIO | AVERAGE THICKNESS [mm] | COATING-AGENT THICKNESS [pm] | Hs (JIS-A) WITH COATING-AGENT | CENTRAL-PORTION NIP WIDTH [mm] | EDGE PORTION NIP WIDTH [mm] | COLD OFFSET |
| 12 | 15 | 2.2 | 0 | 12 | 6.3 | 6 | NO |
| 10 | 10 | 2.2 | 0 | 10 | 6.2 | 6.1 | NO |
| 11 | 20 | 2.3 | 0 | 11 | 6.5 | 6.2 | NO |
| 11 | 15 | 2 | 250 | 15 | 6.1 | 6 | NO |
| 11 | 5 | 2.4 | 200 | 14 | 6 | 6 | NO |
| 8 | 10 | 2 | 0 | 8 | 6.2 | 4.9 | YES |
| 7 | 30 | 1.9 | 0 | 7 | 6.4 | 4.8 | YES |
| 8 | 15 | 1.8 | 0 | 8 | 6.5 | 5.2 | YES |
| 8 | 10 | 2 | 50 | 9 | 6.2 | 4.7 | YES |
| 8 | 15 | 2 | 10 | 9 | 6.1 | 5 | YES |

| HARDNESS | LOAD | NIP WIDTH | PAD/HOLDER SHAPE | SHEET RELEASABILITY | REFERENCE |
|---|---|---|---|---|---|
| Hs (JIS-A) | kgf | mm | mm | | |
| 8 | 40 | 7 |   | UNFAVORABLE | CONVENTIONAL EXAMPLE |
| 8 | 40 | 7 |   | FAVORABLE | FIG. 19, 23 |
| 8 | 40 | 7 |   | FAVORABLE | FIG. 20, 24 |
| 8 | 40 | 7 |   | FAVORABLE | FIG. 21, 25 |

FIXING DEVICE AND IMAGE FORMING APPARATUS

CROSS-REFERENCE TO RELATED APPLICATIONS

The present document incorporates by reference the entire contents of Japanese priority document, 2006-191110 filed in Japan on Jul. 12, 2006, 2006-191111 filed in Japan on Jul. 12, 2006 and 2006-193194 filed in Japan on Jul. 13, 2006.

BACKGROUND OF THE INVENTION

1. Field of the Invention

The present invention relates to a fixing device and an image forming apparatus that includes the fixing device.

2. Description of the Related Art

A typical fixing device that fixes an unfixed toner image on a recording medium by applying pressure and heat thereto includes a heating unit and a pressurizing unit. The heating unit includes an elastic layer and a heat source and the pressurizing unit includes an endless member and a pressurizing member. The recoding medium with an unfixed toner image thereon is conveyed to a nip portion between the heating unit and the pressurizing unit so that the unfixed toner image is fixed to the recoding medium. Various types of such fixing devices that employ the belt-nip method have been proposed. In the belt-nip method, a nip portion is formed in a way that a pressurizing member is pressed against a heating roller that is rotatable and that includes an elastic layer with the surface elastically deformable. The pressurizing member locally deforms a portion of the heating roller on a side from where a recording medium exits the nip portion. However, such deformation tends to change the surface speed of the fixing roller, causing shift of an image on the recording medium. In addition, a hard member is pressed against the elastic layer of the heating roller to locally cause deformation of the elastic layer so that a nip portion having a small curvature is formed. Hence, a large load is applied to the recording medium, for example, an amount of damage on the recoding medium or curling of the recoding medium increases.

To deal with such inconvenience, Japanese Patent Application Laid-open No. 2004-045780 discloses a pressurizing unit including an entering pad on a side from which a recording medium enters a nip portion, an exit pressurizing roller on a side from which the recording medium exits the nip portion, and a center pad between the entering pad and the exit pressurizing roller. The entering pad, the center pad, and the exit pressurizing roller are pressurized individually. The center portion of the pressurizing unit has a lower surface so as to have a V-shaped portion.

Furthermore, Japanese Patent Application Laid-open No. H08-166734 discloses a technology for preventing an image on a recording medium from shifting. Near the exit of a nip portion, a pressurizing roller around which a pressurizing belt extends is pressed against a fixing roller with the surface on which an elastic layer is provided. Accordingly, the elastic layer deforms and the deformation helps a recording medium to be released from fixing roller. An auxiliary roller that includes an elastic layer is provided to an upstream portion in a direction of conveyance of the recording medium. The auxiliary roller is pressed against the fixing roller to prevent the recording medium from being conveyed at a speed higher than that of the surface speed of the fixing roller, thus preventing an image from shifting on the recording medium. The shifting of the image can be effectively prevented when the total of the pressure from the auxiliary roller and the pressure from a tensile force of the pressurizing belt is larger than that from the pressurizing roller.

In addition, Japanese Patent Application Laid-open No. H11-212389 discloses a heating-pressurizing fixing device that includes a heating roller, a pressurizing belt that is pressed against the heating roller, and a pressurizing roller that pressurizes the pressurizing belt. The heating-pressurizing fixing device fixes an unfixed toner image on a recording medium by heat and pressure while causing the recording medium to pass through a nip portion that is formed between and by the heating roller and the pressurizing belt. The heating-pressurizing fixing device further includes a pressurizing member that has a round edge.

Moreover, Japanese Patent Application Laid-open No. S63-036283 discloses a thermal fixing roller that includes a core around which silicon rubber is formed. The silicon rubber has hardness equal to 35 degrees (JIS A) or smaller, a permanent deformation equal to 10% or smaller, a thickness of 1.5 mm to 4 mm. Japanese Patent Application Laid-open No. 2002-207388 discloses an image forming unit that includes a pressurizing belt, a pressurizing-belt supporting member, and a pressuring unit. The pressurizing belt presses a recording medium against a heating-fixing roller. The pressurizing-belt supporting member includes a plurality of supporting members around which the pressurizing belt extends. The pressing unit presses the recording medium between the heating-fixing roller and the outer surface of the pressurizing belt. As the pressing unit, at least a pair of pressing members is provided such that one of the pressing members is positioned on the inner surface of the heating-fixing roller and the other pressing member is positioned on the inner surface of the pressurizing belt.

Furthermore, Japanese Patent Application Laid-open No. H09-251252 discloses a pressurizing member that has a shape in which the thickness of the pressurizing member in the vertical direction gradually decreases from each of the two edges to the center thereof (hereinafter, "inverted-crown shape"). The pressurizing member includes an elastic layer that has the two edge portions whose foam densities are different from that of the center portion of the elastic layer such that the hardness of the edge portions is higher than that of the center potion.

Moreover, Japanese Patent Application Laid-open No. H03-233586 discloses a fixing device that includes a plurality of rollers, an endless belt that is wound around the heating member and the rollers, a heating member, and a pressurizing roller. The heating member has a shape in which the thickness of the heating member in the vertical direction gradually increases from each of the two edges to the center thereof (hereinafter, "crown shape"), and the pressurizing roller has the inverted-crown shape and is pressed against the heating member.

In addition, Japanese Patent Application Laid-open No. H2001-296691 discloses a heating roller that has a diameter equal to 28 mm or smaller. The heating roller includes a rubber layer that has a thickness of 0.5 mm to 10 mm, a hardness of 8 (JIS-A) or smaller. Japanese Patent Application Laid-open No. 2002-25713 discloses a roller that includes an elastic layer that has a hardness of 15 degrees to 55 degrees (Asker-C) and a permanent deformation (compression) of 0.5% to 5%.

SUMMARY OF THE INVENTION

It is an object of the present invention to at least partially solve the problems in the conventional technology.

A fixing device according to one aspect of the present invention includes a heating unit, a pressurizing unit that includes a pressurizing member and a supporting member supporting the pressurizing member. The fixing device fixes an unfixed toner image on a recording medium by applying a heat with the heating unit and a pressure with the pressurizing unit to the unfixed toner image on the recording medium located in a nip portion between the heating unit and the pressurizing unit. The pressurizing member includes an elastic member that has a uniform elastic modulus of K=EA/t, where E is a Young's modulus, A is an area of the nip portion, and t is a thickness of the elastic member in a direction of application of load. The supporting member has an entering portion on an entering side from where the recording medium enters the nip portion, an exit portion on an exit side from where the recording medium exits the nip portion, and a center portion between the entering portion and the exit portion, a thickness of the center portion in the direction of application of load being larger than thicknesses of the entering portion and the exit portion in the direction of application of load so that the supporting unit has a convex portion.

An image forming apparatus according to another aspect of the present invention includes a plurality of developing units for forming toner images of colors different from each other; a photoreceptor that has a surface to which the toner images are transferred; an intermediate transfer unit for transferring a transferred toner images on the photoreceptor thereto; a transfer unit that transfers the transferred toner image on the intermediate transfer unit to a recording medium; and a fixing unit including a heating unit, a pressurizing unit that includes a pressurizing member and a supporting member supporting the pressurizing member. The fixing device fixes an unfixed toner image on a recording medium by applying a heat with the heating unit and a pressure with the pressurizing unit to the unfixed toner image on the recording medium located in a nip portion between the heating unit and the pressurizing unit. The pressurizing member includes an elastic member that has a uniform elastic modulus of K=EA/t, where E is a Young's modulus, A is an area of the nip portion, and t is a thickness of the elastic member in a direction of application of load. The supporting member has an entering portion on an entering side from where the recording medium enters the nip portion, an exit portion on an exit side from where the recording medium exits the nip portion, and a center portion between the entering portion and the exit portion, a thickness of the center portion in the direction of application of load being larger than thicknesses of the entering portion and the exit portion in the direction of application of load so that the supporting unit has a convex portion.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 16 is a table containing the results of evaluation tests on the fixing devices shown in FIGS. 13 and 15;

DETAILED DESCRIPTION OF THE PREFERRED EMBODIMENTS

Exemplary embodiments of the present invention are explained in detail below with reference to the accompanying drawings.

Figure 1:
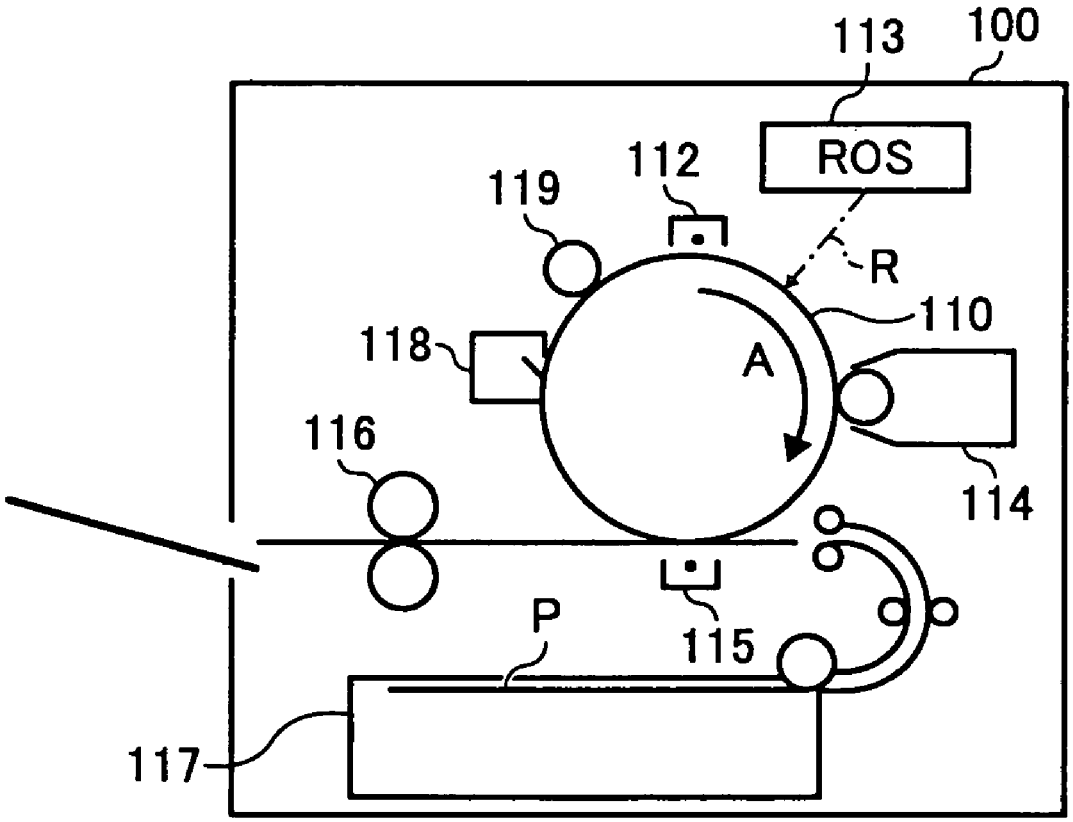
FIG. 1 is a schematic diagram of an image forming apparatus according to an embodiment of the present invention.

FIG. 1 is a schematic of an image forming apparatus 100 according to a first embodiment of the present invention. The image forming apparatus 100 includes a photoreceptor 110 that rotates in the direction indicated by an arrow A, a scorotron charging unit 112 that electrically charges the surface of the photoreceptor 110; a raster output scanner (ROS) 113 that forms a electrostatic latent image on the surface of the photoreceptor 110 by exposing the surface with a ray R of light modulated with information on an image, a developing unit 114 that forms a toner image on the surface of the photoreceptor 110 by developing the electrostatic latent image thereon with toner, a transfer unit 115 that transfers the toner image on the surface of the photoreceptor 110 to a paper sheet P, a fixing device 116 that fixes the toner image on the paper sheet P, a sheet tray 117 for storing therein paper sheets P, a cleaner 118 that cleans the surface of the photoreceptor 110, and a removing unit 119 that removes residual static electricity residing on the surface of the photoreceptor 110.

Operations of the image forming apparatus for forming an image are explained below with reference to FIG. 1. First, an original image signal read from an original by an image reading unit (not shown), or an original signal generated by, for example, an external computer (not shown) is input to an image processing unit (not shown) and image processing is performed properly. In this manner, an input image signal is obtained. The input image signal is input to the ROS 113 and used to modulate the ray R. The modulated ray R is applied to the surface of the photoreceptor 110 that is electrically charged by the scorotron charging unit 112. In this manner, raster scanning is performed, and thus, an electrostatic latent image that corresponds to the input image signal is formed on the surface of the photoreceptor 110.

The electrostatic latent image on the surface of the photoreceptor 110 is developed by the developing unit 114 with toner so that a toner image is formed on the surface of the photoreceptor 110. With the rotation of the photoreceptor 110, the toner image is conveyed to the transfer unit 115 that is arranged so as to be opposed to the photoreceptor 110.

Meanwhile the paper sheet P stored in the sheet tray 117 is fed to a nip portion between the photoreceptor 110 and the transfer unit 115. The transfer unit 115 transfers the toner image from the surface of the photoreceptor 110 to the paper sheet P. The paper sheet P with the toner image thereon is conveyed to the fixing device 116 and the fixing device 116 fixes the toner image. In this manner, a desired image is obtained.

After the transfer of the toner image to the paper sheet S, the cleaner 118 cleans residual toner residing on the surface of the photoreceptor 110. The removing unit 119 removes the residual static electricity residing on the surface of the photoreceptor 110. In this manner, one cycle of the operations for forming an image is completed.

Figure 2:
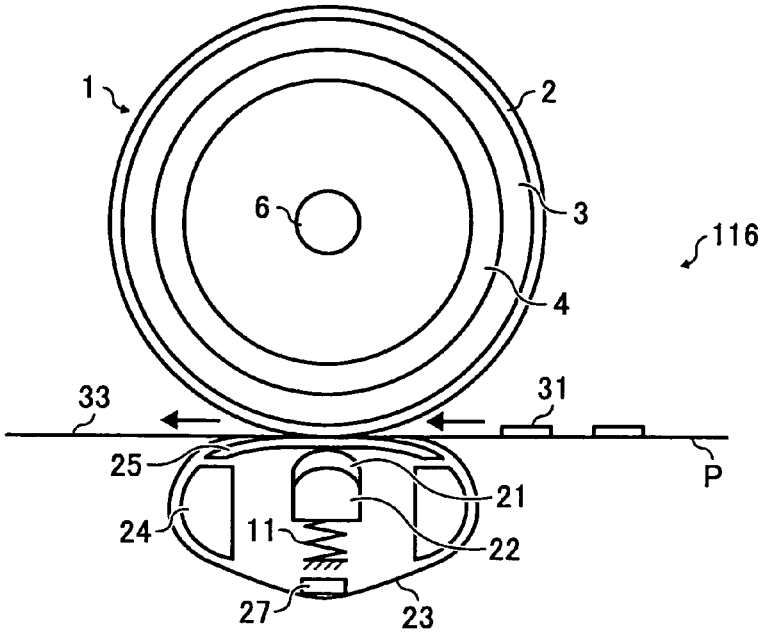
FIG. 2 is a schematic diagram of a fixing device according to a first example of a first embodiment of the fixing device shown in FIG. 1.

FIG. 2 is a schematic of the fixing device 116 of the image forming apparatus 100. A heating-fixing roller 1 includes a surface-covering layer 2, an elastic layer 3, a core 4, and a heat source 6. The heating-fixing roller 1 is driven to rotate. A paper sheet P with unfixed toner 31 on its surface is conveyed in the direction indicated by an arrow shown in FIG. 2. A pressurizing unit is provided such that the paper sheet P is sandwiched between the heating-fixing roller 1 and the pressurizing unit. The pressurizing unit includes a pressurizing member 21, a supporting member 22 that supports the pressurizing member 21, a pressing pressurizing spring 11 that presses the pressurizing member 21 and the supporting member 22 against the paper sheet P, an endless member 23 that is driven to rotate, a friction-reducing member 25 for reducing friction between the endless member 23 and the pressurizing member 21, and a guiding member 24 that defines a path of the endless member 23. Each of the pressurizing member 21 and the supporting member 22 has a round portion along the sheet direction. A lubricant-supplying member 27 supplies a lubricant for further reducing friction between the endless member 23 and the pressurizing member 21.

As a lubricant of the lubricant-supplying member 27, one containing silicon oil or fluorine oil is generally used. A fixed image 33 is obtained after the paper sheet P passes through a nip portion formed between the heating-fixing roller 1 and the endless member 23. As the surface-covering layer 2, for example, a PFA layer is used to prevent the unfixed toner 31 to be adhered to the heating-fixing roller 1. As the elastic layer 3, for instance, silicon rubber or fluororubber is generally used. When silicon rubber is used, the elastic layer 3 may be coated with, for example, a fluorine layer or the like to improve swelling resistance. The endless member 23 is made of PFA and polyimide. As the pressurizing member 21, a pressurizing pad with the flat surface to which a pressure is applied is used. The pressurizing member 21 includes an elastic member formed of silicon rubber or fluorine rubber. As the paper sheet P, any type of recording medium such as a cut sheet can be used.

Figure 3:
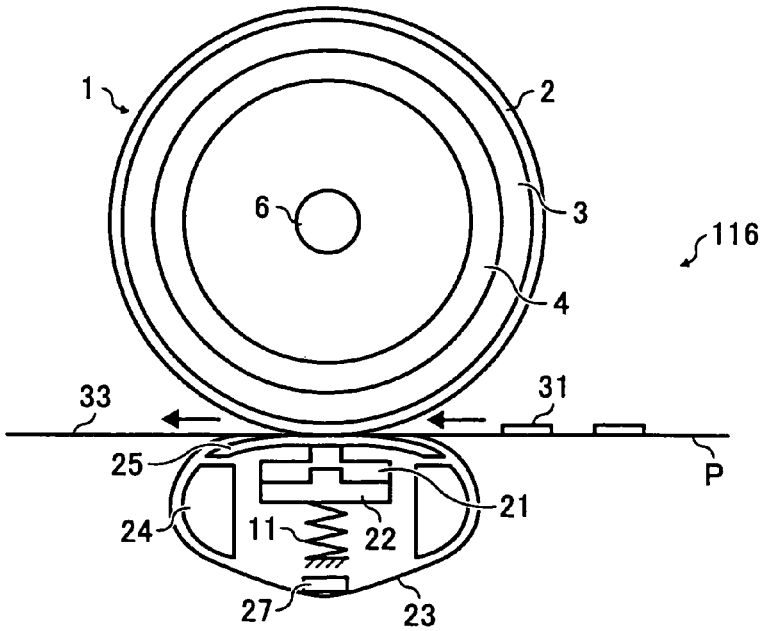
FIG. 3 is a schematic diagram of a fixing device according to a second example of the first embodiment.

FIG. 3 is a schematic diagram of the fixing device 116 according to a second example of the first embodiment. In the second example, the supporting member 22 has a step-shaped portion. Except for the supporting member 22, the structure of the second example is same as that of the fixing device 116 shown in FIG. 2.

Figure 4:
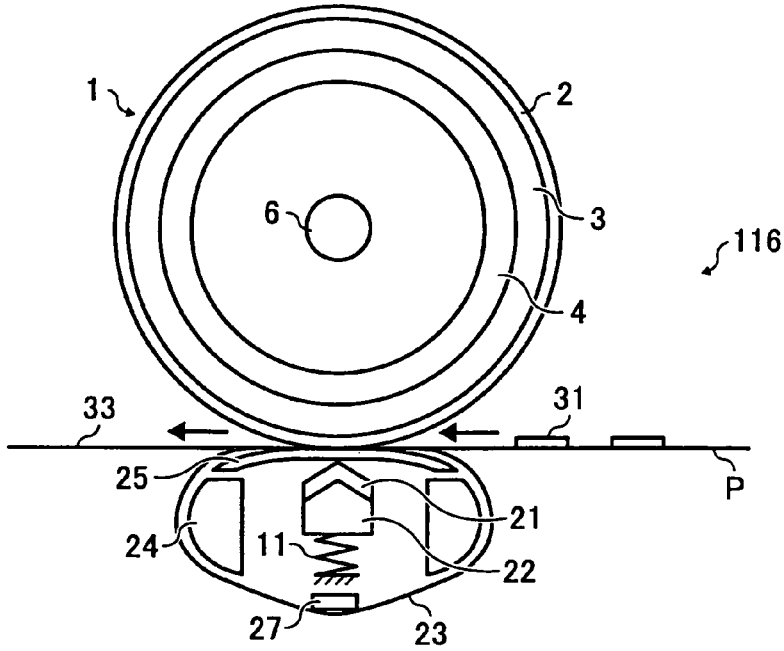
FIG. 4 is a schematic diagram of a fixing device according to a third example of the first embodiment.

FIG. 4 is a schematic diagram of the fixing device 116 according to a third example of the first embodiment. In the third example, the supporting member 22 has an inverted V-shaped portion. Except for this point, the structure of the third example is same as that of the fixing device 116 shown in FIG. 2.

Figure 5:
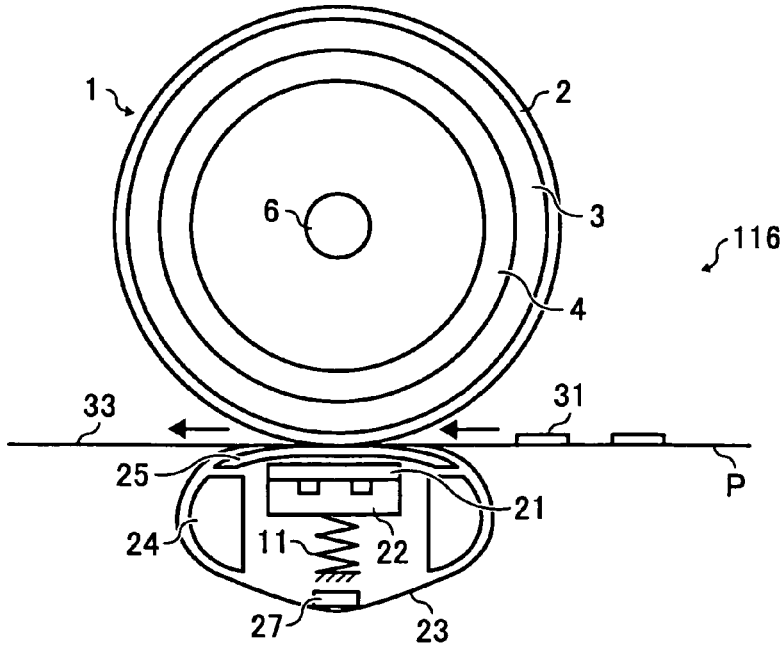
FIG. 5 is a schematic diagram of a fixing device according to a fourth example of the first embodiment.

FIG. 5 is a schematic diagram of the fixing device 116 according to a fourth example of the first embodiment. In the fourth example, two spaces are present between the pressurizing member 21 and the supporting member 22 at an entering side from where the paper sheet P enters the nip portion and at an exit side from where the paper sheet P exits the nip portion. Except for this point, the structure of the fourth example is same as that of the fixing device 116 shown in FIG. 2.

Figure 6:
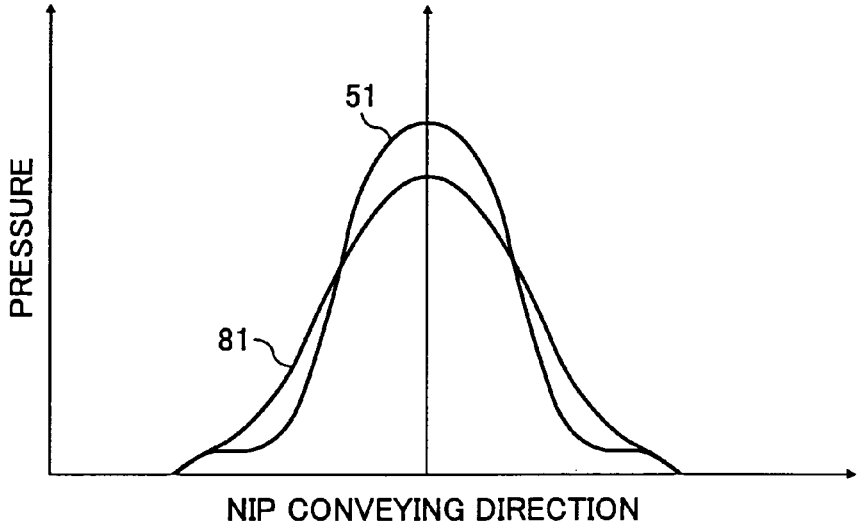
FIG. 6 is a diagram indicating a pressure distribution of a conventional fixing device and a pressure distribution of the fixing devices shown in FIGS. 2 to 5.

FIG. 6 is a diagram indicating an example of pressure distribution, along the sheet direction, of the heating-fixing roller 1 at the nip portion. The pressure distribution is obtained when the pressurizing member 21 is pressed against the heating-fixing roller 1 in each of the types shown in FIGS. 2 to 5. The diagram also indicates another comparative example of pressure distribution. The vertical axis shown in FIG. 6 is a pressure scale and the horizontal axis is a scale of a direction in which the heating-fixing roller 1 rotates (circumferential direction) and the paper sheet P is conveyed. The diagram represents that the paper sheet P is conveyed to the nip portion between the heating-fixing roller 1 and the pressurizing member 21 from the left (from the side of the vertical axis). Hereinafter, the left side of the diagram is referred to as "nip entrance", and the right side thereof is referred to as "nip exit". The width of the nip portion (hereinafter, "nip width") is a width in the sheet direction.

A curved line 81 shown in FIG. 6 is the comparative example indicating pressure distribution obtained when the elastic member of the pressurizing member 21 has the uniform hardness and the thickness in the load application direction. For comparison, the distribution is simplified. A curved line 61 indicates the example of pressure distribution obtained with the elastic member in a shape different from that of the comparative example. Specifically, the thickness of the center portion of the supporting member 22 at the nip portion is larger than thicknesses of the entering portion and the exit portion. The conditions on the structure of the heating-fixing roller 1, the load to be applied to the elastic member, and the nip width (the width of the pressurizing pad can be changed) are the same when the pressure distributions indicated by the curved line 61 is obtained and when the pressure distribution indicated by the curved line 81 is obtained. As shown in FIG. 6, the peak pressure on the curved line 81 is lower than that on the curved line 61, and the curved line 81 indicates that the pressure varies gently from the nip entrance to the nip exit.

Figure 7:
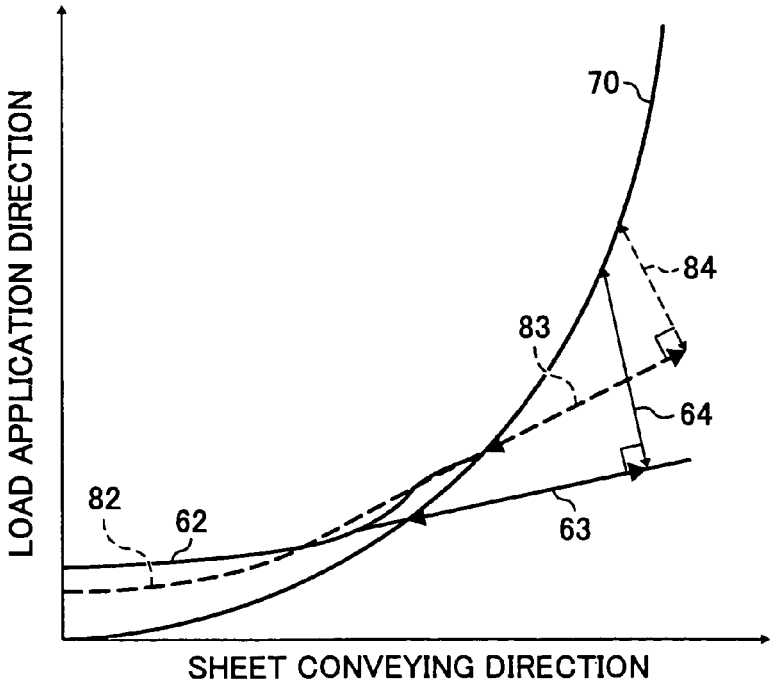
FIG. 7 is a diagram indicating examples of deformation of an elastic layer of a heating-fixing roller of the fixing device according to the embodiment in a direction of transfer of a recording medium.

FIG. 7 is a diagram indicating an example of deformation of the elastic layer 3 of the heating-fixing roller 1 in the sheet direction. A curved line 70 represents the shape of the surface of the heating-fixing roller 1 before it deforms, and a curved line 82 represents the shape of the elastic layer 3 (hereinafter, "nip shape") deformed with the pressure distribution indicated by the curved line 81 shown in FIG. 6. A straight line 83 represents a paper sheet that exits the nip portion along the nip shape. A clearance 84 represents a distance between a point on the curved line 70 and a point on the straight line 83 from where a line orthogonal to the straight line 83 extends to the point on the curved line 70. A curved line 62 represents the nip shape of the elastic layer 3 deformed with the pressure distribution indicated by the curved line 61 shown in FIG. 6. A straight line 63 represents a paper sheet that exits the nip portion along the nip shape. A clearance 64 represents a distance between a point on the curved line 70 and a point on the straight line 63 from where a line orthogonal to the straight line 63 extends to the point on the curved line 70. The larger the clearance 64 is, the more the paper sheet is easily released from the surface of the heating-fixing roller 1. The diagram indicates that the clearance depends largely on the amount of deformation of the elastic layer 3 and the outer surface of the heating-fixing roller 1. For this reason, an increase in the amount of modification of the elastic layer 3 in the load application direction improves releasability of the paper sheet from the heating-fixing roller 1 (hereinafter, "sheet releasability").

Figure 8:
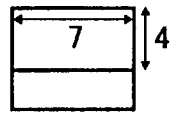
FIG. 8 is a table containing results of evaluation tests on sheet releasability of the fixing devices shown in FIGS. 2 to 5.
Figure 8:
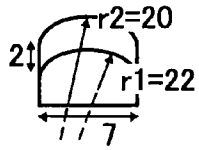
Figure 8:
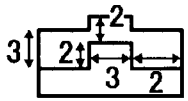
Figure 8:
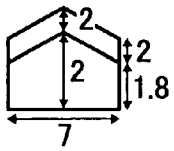
Figure 8:
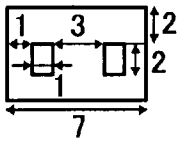

FIG. 8 is a table containing the results of the evaluation tests on the sheet releasability, using fixing devices shown in FIGS. 2 to 5, each fixing device including a heating-fixing roller made by SWCC Showa Cable Systems Co., Ltd. The heating-fixing roller had an outer diameter of ϕ27 mm. The heating-fixing roller included an elastic layer having a thickness of 1.0 mm, a hardness of 8 Hs (JIS-A), a permanent deformation of 4%, and a length in an axial direction of 230 mm. Each of the fixing devices included a pressurizing unit, and the structures of the pressurizing units were different from one another, and a load of 40 kgf was applied to each of the fixing units for the evaluation tests. The same conditions including a certain nip width were applied to each of the evaluation tests. Note that a nip width shown in FIG. 8 is a reference value.

In the evaluation tests, a full-color image was formed and fixed on a generally-used cut paper sheet with a basis weight of 55 g/cm$^2$. As a result of the evaluation tests, it was found that the pressurizing pads of the pressurizing members having the respective shapes shown in FIGS. 2 to 5 improve the sheet releasability as shown in FIG. 7 compared with the pressurizing member that has a thickness in the load application direction of 4 mm and includes an elastic member with a hardness of 8 Hs (JIS-A) and a permanent deformation of 4% and. The sheet releasability improves because the elastic layer of the heating-fixing roller deforms appropriately depending on the appropriate differences between the elastic moduli of the elastic-member entering portion and the elastic-member center portion of the pressurizing member and between the elastic moduli of the elastic-member exit portion and the elastic-member center portion thereof. The differences are equal to a value larger than a certain value. If the permanent deformation of the elastic layer of the heating-fixing roller is large, image deterioration, such as uneven gloss of an image may be caused.

The results of the evaluation tests indicated that a permanent deformation equal to 5% or larger increases the amount of uneven gloss of an image, and that a permanent deformation equal to 4% or smaller is desirable. Based on the idea that a large clearance between the surface of the heating-fixing roller and the sheet surface improves the sheet releasability, the outer surface of the heating-fixing roller is also a parameter for defining the clearance. The results also indicated that an outer diameter equal to ϕ27 mm or larger lowers the sheet releasability. Hence, it is desirable that the heating-fixing roller have an outer diameter equal to ϕ27 mm or smaller.

The test results also indicated that the thickness of the elastic layer of the heating-fixing roller is a parameter for defining the clearance. It was found that a thickness of the elastic layer equal to 0.8 mm or smaller lowers the sheet releasability because a small thickness of the elastic layer leads to a small amount of deformation of the elastic layer so that the paper sheet cannot be in an appropriate state at the nip exit. For this reason, it is desirable that the elastic layer have a thickness equal to 0.8 mm or more.

The test results also indicated that the hardness of the elastic layer of the heating-fixing roller is a parameter for defining the clearance. It was found that the hardness of the elastic layer equal to 8 Hs (JIS-A) or larger lowers the sheet releasability. The sheet releasability is lowered because a large hardness of the elastic layer leads to a small amount of the deformation of the elastic layer so that the sheet cannot be in an appropriate state at the nip exit. For this reason, it is desirable that the elastic layer have a hardness of 8 Hs (JIS-A) or smaller.

A large permanent deformation of the pressuring member may cause a temporal change of the nip shape so that the fixing characteristics of toner to the sheet and the sheet releasability are unstable. The results of the evaluation tests indicated that a permanent deformation equal to 5% or larger lowers the sheet releasability after the heating-fixing roller was heated and rotated for 100 hours or more. For this reason, it is desirable that the pressurizing member have a permanent deformation of 4% or smaller.

Figure 9:
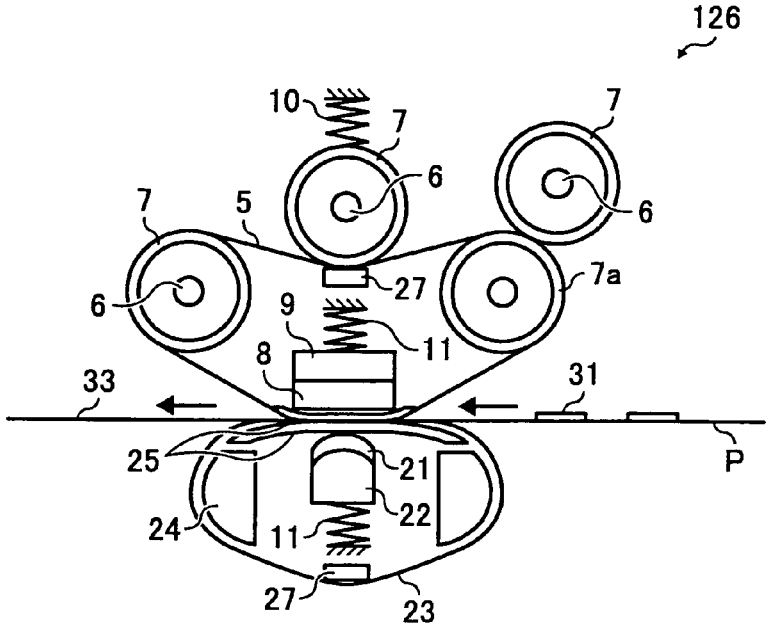
FIG. 9 is a schematic diagram of a fixing device according to a first example of a second embodiment of the fixing device shown in FIG. 1.

FIG. 9 is a schematic of a fixing device 126 according to a second embodiment of the present invention. The same reference numerals of the fixing device 116 are given to members of the fixing device 126 that are same as or similar to those of the fixing device 116. The fixing device 126 includes an endless heating member 5 that faces the surface of a paper sheet P with a toner image thereon, the heating member 8 that includes an elastic layer, a pressurizing-supporting member 9 that supports the heating member 8, the heat source 6, a pressurizing spring 10, and heating rollers 7 across which the endless heating member 5 extends. The heating rollers can be configured to heat the endless heating member 5. If heat applied to the endless heating member 5 is insufficient, the heating roller 7 can be caused to be in contact with the outer surface of the endless heating member 5 to heat the endless heating member 5.

A driven roller **7*a* has no heat source and is driven to rotate. Each of the heating rollers 7 has a drive source to drive the endless heating member 5. Alternatively, the driven roller 7*a* can have a drive source. The use of the endless heating member 5 instead of the heating-fixing roller 1 allows adjustment of the nip width and the deformation of the endless heating member 5 on a side from which the paper sheet S exits from a nip portion with little change of the size of the fixing device 126. Each of the pressurizing member 21 and the supporting member 22 has a round portion. In this structure, the width of the pressurizing member 21 needs to be equal to or smaller than the width of the heating member 8**.

Figure 10:
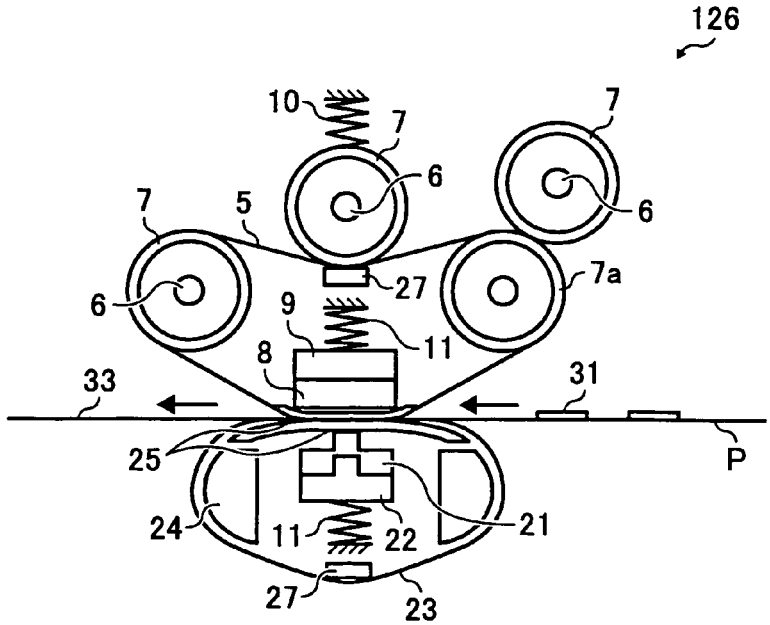
FIG. 10 is a schematic diagram of a fixing device according to a second example of the second embodiment.

FIG. 10 is a schematic diagram of the fixing device 126 according to a second example of the second embodiment. The fixing device 126 includes the supporting member 22 that has a step-shaped portion, and has the same structure, except for the supporting member 22, as that of the fixing device 126 shown in FIG. 9.

Figure 11:
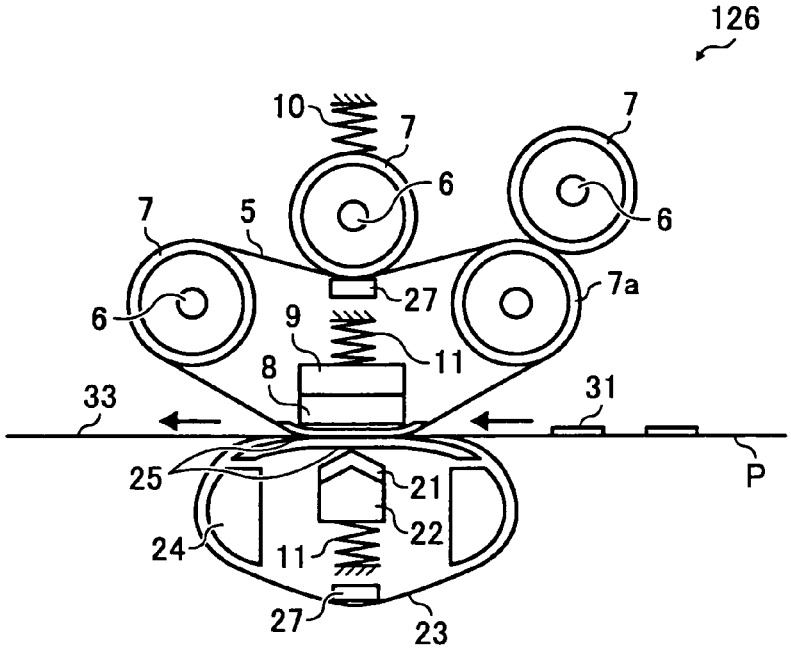
FIG. 11 is a schematic diagram of a fixing device according to a third example of the second embodiment.

FIG. 11 is a schematic diagram of the fixing device 126 according to a third example of the second embodiment. The fixing device 126 includes the supporting member 22 that has an inverted V-shaped portion, and has the same structure, except for the supporting member 22, as that of the fixing device 126 shown in FIG. 9.

Figure 12:
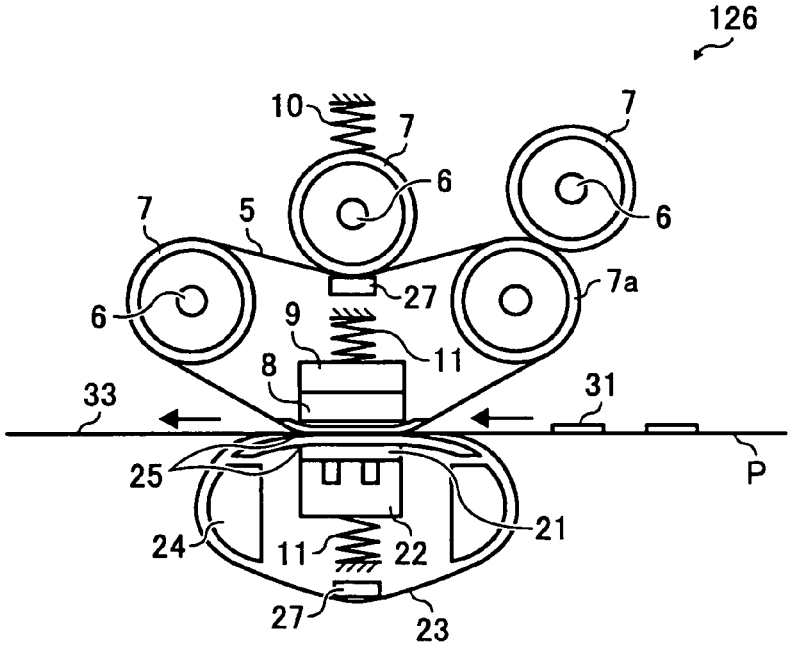
FIG. 12 is a schematic diagram of a fixing device according to a third example of the second embodiment.

FIG. 12 is a schematic diagram of the fixing device 126 according to a third example of the second embodiment. Two spaces are present between the pressurizing member 21 and the supporting member 22 at the "entering side" and the "exit side". Except for the above spaces, the fixing device 126 shown in FIG. 12 has the same structure as that of the fixing device 126 shown in FIG. 9.

As described, the elastic member of the pressurizing member 21 has the uniform elastic modulus of K=EA/t, where E is a Young's modulus, A is an area of a nip portion, and t is a thickness of the elastic member in the load application direction. In addition, the supporting member 22 has the center portion having a thickness in the load application direction larger than those of the entering portion and the exit portion, and thus, the supporting member 22 has a convex portion. The convex portion locally deforms the elastic layer 3 of the heating-fixing roller 1, so that the sheet can be in an appropriate state at the nip exit. This reduces the amount of the shift of an image on a recording medium and a load applied to the recording medium, and the sheet releasability improves effectively.

In addition, the width of the elastic member is made appropriate so that the elastic layer 3 of the heating-fixing roller 1 deforms. Accordingly, the sheet can be in an appropriate state at the nip exit. This reduces the amount of the shift of an image on a recording medium and a load applied to the recording medium, and the sheet releasability improves effectively. As described, the convex portion of the supporting member 22 can be a step-shaped portion, a round portion, or an inverted V-shaped portion. Instead of the above convex portion, two spaces can be provided between the pressurizing member 21 and the supporting member 22 at the entering side and the exit side. The above spaces realize the same effects as those realized by each of the fixing devices 116 shown in FIGS. 2 to 5.

The use of the heating roller 7 realizes the entire image forming apparatus at a low cost and the same effects as those realized by each of the fixing devices 116 of the first to fourth examples shown in FIGS. 2 to 5.

According to the second embodiment, the use of the heating belt realizes high-speed fixing.

The use of the fixing devices according to the first and the second embodiments in an image forming apparatus makes the overall structure of the image forming apparatus simple. In addition, the fixing devices improve the releasability of the recording medium from the heating unit without application of a heavy load to the recording medium, thereby improving the quality of an image formed on the recording medium.

Figure 13:
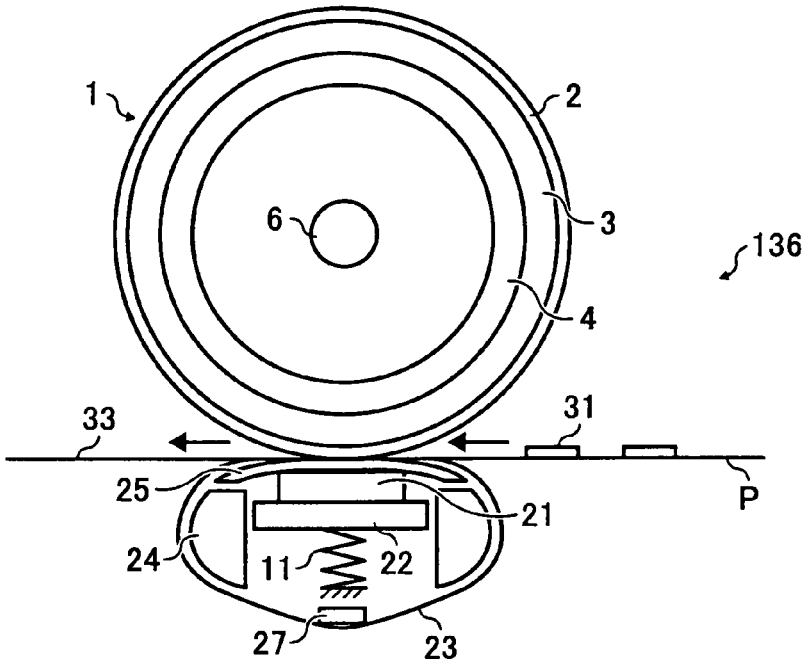
FIG. 13 is a schematic diagram of a fixing device according to a third embodiment of the fixing device shown in FIG. 1.

FIG. 13 is a schematic diagram of a fixing device 136 according to a third embodiment of the fixing device 116 shown in FIG. 1. The same reference numerals as those of the fixing device 116 shown in FIG. 2 are given to the same members of the fixing device 136 shown in FIG. 13. The heating-fixing roller 1 includes the surface-covering layer 2, the elastic layer 3, the core 4, and the heat source 6, has an "inverted crown shape", and is driven to rotate. The recording medium P is transferred in the direction indicated by an arrow shown in FIG. 13. A pressurizing unit is provided so as to be opposed to the heating-fixing roller 1. The members constituting the fixing device 136 shown in FIG. 13 have the same structures and are made of the same materials as those of the fixing device 116 of the first example shown in FIG. 2. Thus, the same explanation is omitted below.

Figure 14:
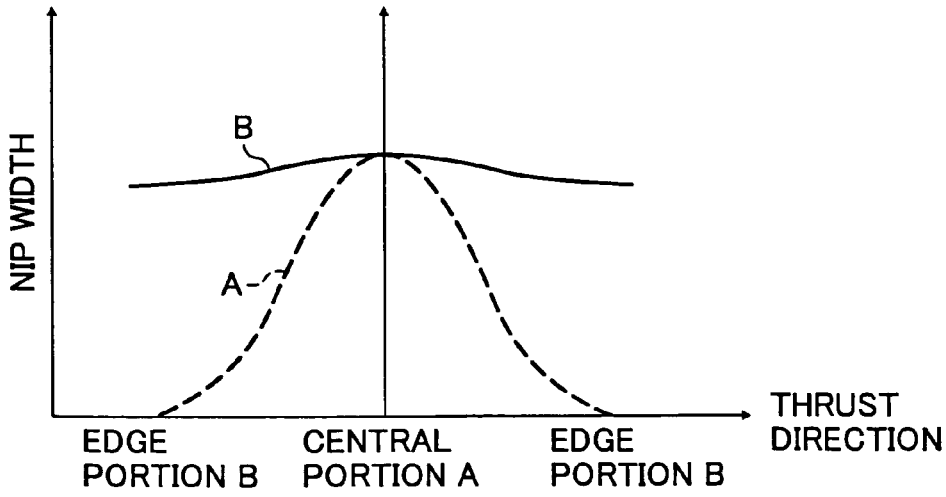
FIG. 14 is a schematic diagram indicating a nip width obtained in the conventional fixing device and a nip width obtained in the fixing device shown in FIG. 13.

FIG. 14 is a schematic diagram indicating a width of a nip portion on the pressurizing member 21 in a thrust direction of the pressurizing member 21 (a direction perpendicular to the sheet direction), the nip portion being obtained by pressing the pressurizing member 21 against the heating-fixing roller 1. The vertical axis shown in FIG. 14 is a nip width scale and the horizontal axis is a thrust-direction scale. A curved line A indicates the nip width obtained in a conventional fixing device. The curved line A indicates that the nip widths on the edge portions B are extremely smaller than that on the central portion A. The difference in the nip widths among the above portions causes cold offset. On the other hand, in the fixing device 136 shown in FIG. 13, as indicated by a curved line B, each of the nip widths of the edge portions B are close to that of the central portion A.

Figure 15:
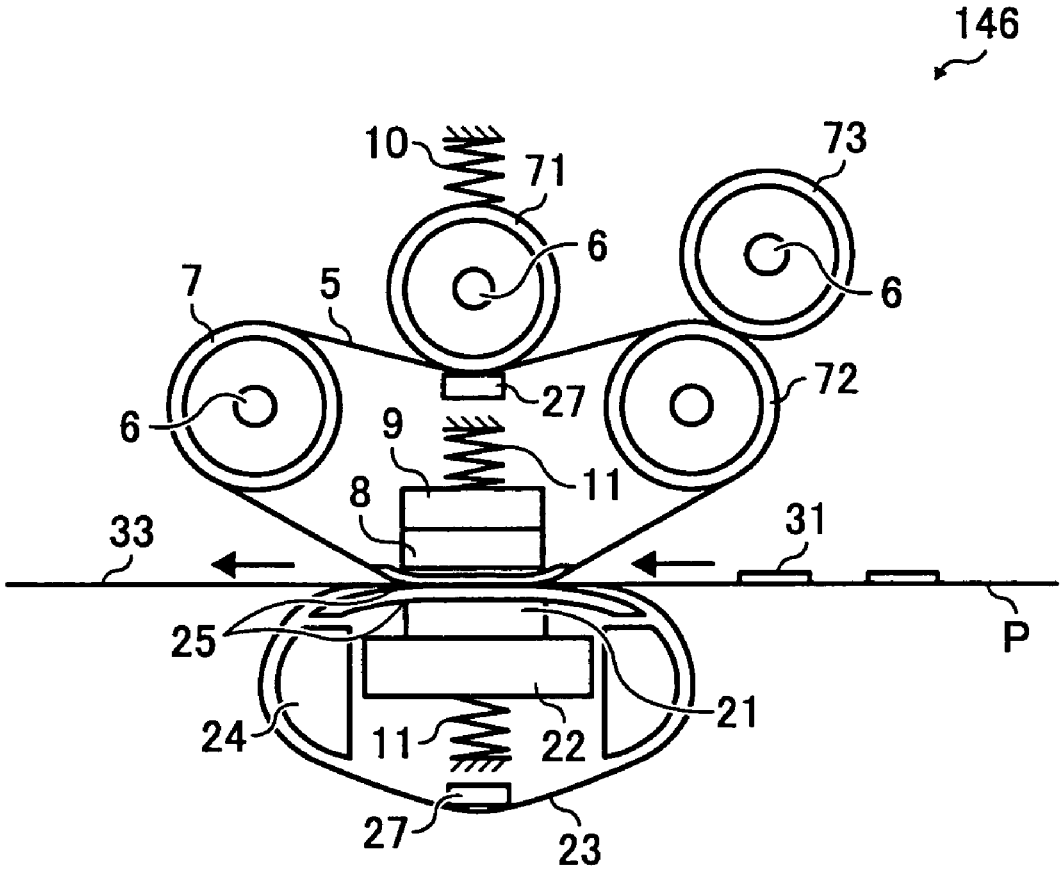
FIG. 15 is a schematic diagram of a fixing device according to a fourth embodiment of the fixing device shown in FIG. 1.

FIG. 15 is a schematic of a fixing device 146 according to a fourth embodiment of the present invention. The same reference numerals of the fixing device 116 shown in FIG. 2 are given to members of the fixing device 146 that are same as those of the fixing device 116. The fixing device 146 includes the endless heating member 5 that faces the surface of a paper sheet P with a toner image thereon, the heating member 8 that includes an elastic layer, a pressurizing-supporting member 9 that supports the heating member 8, the heat source 6, a pressurizing spring 10, and a heating roller 7 across which the endless heating member 5 extends. The heating rollers can be configured to heat the endless heating member 5. If heat applied to the endless heating member 5 is insufficient, any one of heating rollers 71 and 73 can be caused to be in contact with the outer surface of the endless heating member 5 to heat the endless heating member 5. A driven roller 72 has no heat source and is driven to rotate. The heating rollers 7 each have a drive source to drive the endless heating member 5. Alternatively, the driven roller 72 can have a drive source. The use of the endless heating member 5 instead of the heating-fixing roller 1 allows adjustment of the nip width and the deformation of the endless heating member 5 on a side from which the paper sheet S exits from a nip portion with little change of the size of the fixing device 126. In this structure, the width of the pressurizing member 21 needs to be equal to or smaller than the width of the heating member 8.

Figure 17:
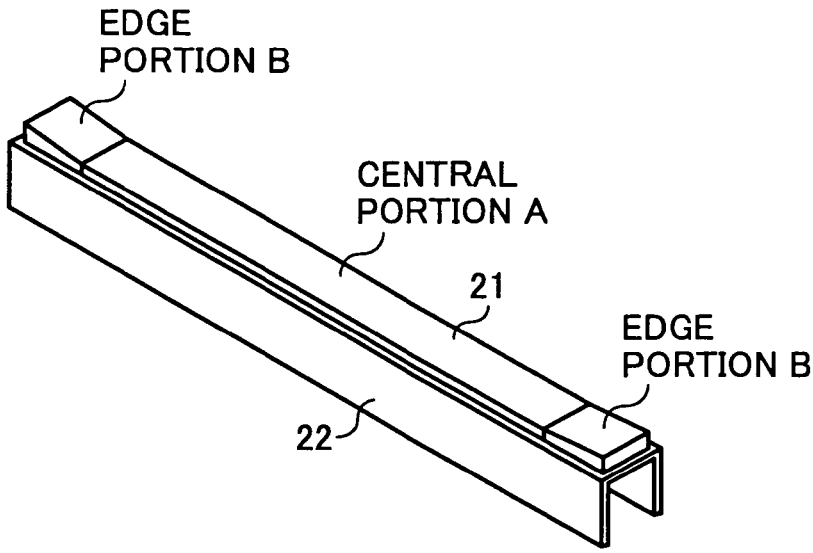
FIG. 17 is a perspective view of a pressurizing member that is used in the evaluation tests of the results contained in FIG. 16.
Figure 18:
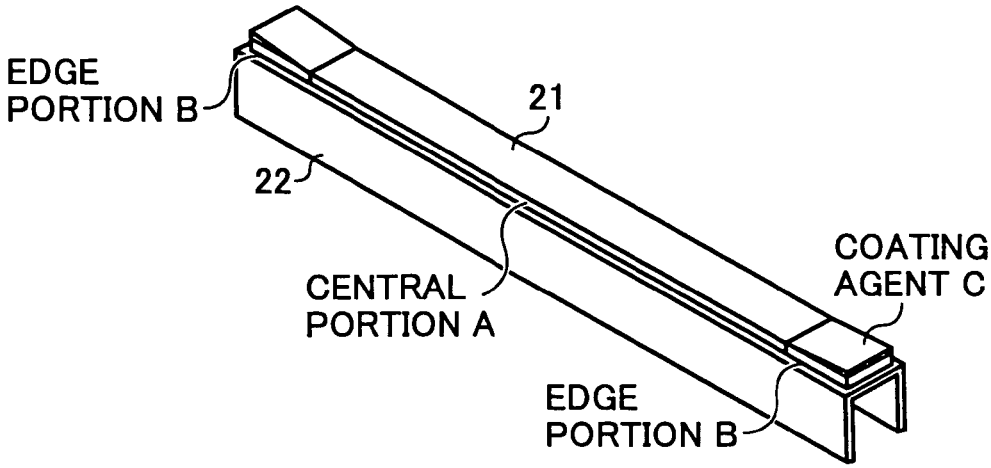
FIG. 18 is a perspective view of a pressurizing member that is used in the evaluation tests of the results contained in FIG. 16 and that has a coating agent on its surface.

FIG. 16 is a table containing the results of the evaluation tests on the fixing devices 136 and 146 shown in FIGS. 13 and 15. In each of the evaluation tests, a nip width was measured and whether cold offset occurs was observed. A thermal fixing roller manufactured by SWCC Showa Cable Systems Co., Ltd was used as the heating-fixing roller 1. The heating-fixing roller 1 had an outer diameter of ϕ27 mm. The pressurizing member 21 included an elastic member having a thickness of 1.0 mm, a hardness of 8 Hs (JIS-A), a permanent deformation of 4%, and a length in an axial direction of 230 mm. A different type of the pressurizing member 21 having a different structure was used in each of the evaluation tests. FIG. 17 is a perspective view of the pressurizing member 21 used in the evaluation tests. The pressurizing member 21 includes an elastic member that has a central portion A and two edge portions B. FIG. 18 is a perspective view of the pressurizing members 21 used in the evaluation tests with a coating agent C on its surface. A load of 40 kgf was applied the pressurizing member 21 in each of the evaluation tests. Each of the evaluation tests were carried out under the same conditions. As the paper sheet P, a generally-used cut sheet with a basis weight of 55 g/cm$^2$ was used. Each evaluation test was performed using the paper sheet P of the above type having thereon a full-color image that is obtained by applying all colors to the entire surface of the paper sheet P at the maximum output.

As a result of the evaluation tests, it was found that no cold offset occurred in the pressurizing members 21 each having the edge portions B with a hardness and a thickness that are larger than those of the central portion A. The nip widths of the central portion A and the edge portions B were measured in the following manner, using an OHP film CG3700 manufactured by Sumitomo 3M Ltd. When the OHP film was passing through a nip portion, the power was turned off and the OHP film kept in the nip portion for twelve seconds. The pressure application to the OHP film was then stopped, and the width of the mark of the nip portion that was formed by heat on the OHP film was measured. Whether cold offset occurs was confirmed by use of a white fabric of hanicot #440 and manufactured by Sakata Inks Corp, in the following manner. After the unfixed toner image on the paper sheet P was fixed, the paper sheet P is rubbed with the white fabric and whether unfixed toner is attached to the fabric was confirmed. In the table shown in FIG. 16, the word "YES" indicates that cold offset occurred and the word "NO" indicates that no cold offset occurred.

The table shown FIG. 16 indicates that cold offset occurred with the pressurizing member 21 that has the edge portions B having hardness and a thickness equal to or smaller than those of the central portion A. Specifically, when a pressure was applied to the pressing member 21, the thickness of the above edge portion B became smaller than that of the central portion A. Accordingly, the width of the nip on each of the edge portions B became small, and thus, cold offset occurred. The table also indicates that the uniform nip width on the pressurizing member 21 can be realized by application of the coating agent C to the surface of the pressurizing member 21. Specifically, because of such application, the thickness, the hardness, and the volume of the central portion A were different from those of the edge portions B so that the uniform nip width was realized. Note that, when the total volume of the nip portions B is more than 20% of the entire volume of the pressurizing member 21, sheet releasability was low because the hardness of each of the edge portions B is larger than that of the central portion A. It is preferable that the hardness of the central portion A be small so that the sheet releasability thereof improves. Although the average thickness of the central portion A and the average thickness of the center portions B are shown in the table as the thicknesses thereof, the surface of the central portion A and the surfaces of the center portions B need to form a smooth surface that corresponds to the nip portion. If the central portion A has a thickness greatly different from those of the edge portions B, image-quality deterioration such as uneven gloss and a stripe in the sheet direction on an image would be caused.

Although the table shown in FIG. 6 does not indicate, it was found that a pressurizing member that has a thickness in the load application direction of 2 mm and that includes an elastic member with a hardness of 8 Hs (JIS-A) and a permanent deformation of 4% realizes the sheet releasability better than that realized by a pressurizing member that has a thickness in the load application direction of 4 mm and that includes an elastic member with a hardness of 8 Hs (JIS-A) and a permanent deformation of 4%. If the permanent deformation of the elastic layer 3 of the heating-fixing roller 1 is large, image deterioration, such as uneven gloss of an image may be caused.

The results of the evaluation tests indicated that a permanent deformation equal to 5% or larger increases the amount of uneven gloss of an image, and that a permanent deformation equal to 4% or smaller is desirable. Based on the idea that a large clearance between the surface of the heating-fixing roller 1 and the sheet surface improves the sheet releasability, the outer surface of the heating-fixing roller 1 is also a parameter for defining the clearance. An outer diameter equal to ϕ28 mm or larger lowers the sheet releasability. Hence, it is desirable that the heating-fixing roller 1 have an outer diameter equal to ϕ28 mm or smaller.

The test results also indicated that the thickness of the elastic layer 3 of the heating-fixing roller 1 is a parameter for defining the clearance. It was found that a thickness of the elastic layer equal to 0.8 mm or smaller lowers the sheet releasability because a small thickness of the elastic layer 3 leads to a small amount of deformation of the elastic layer so that the paper sheet cannot be in an appropriate state at the nip exit. For this reason, it is desirable that the elastic layer 3 have a thickness equal to 0.8 mm or more.

The test results also indicated that the hardness of the elastic layer 3 of the heating-fixing roller 1 is a parameter for defining the clearance. It was found that the hardness of the elastic layer equal to 8 Hs (JIS-A) or larger lowers the sheet releasability. The sheet releasability is lowered because a large hardness of the elastic layer leads to a small amount of the deformation of the elastic layer so that the sheet cannot be in an appropriate state at the nip exit. For this reason, it is desirable that the elastic layer 3 have a hardness of 8 Hs (JIS-A) or smaller.

A large permanent deformation of the pressuring member 21 may cause a temporal change of the nip shape so that the fixing characteristics of toner to the sheet and the sheet releasability are unstable. The results of the evaluation tests indicated that a permanent deformation equal to 5% or larger lowers the sheet releasability after the heating-fixing roller was heated and rotated for 100 hours or more. For this reason, it is desirable that the pressurizing member have a permanent deformation of 4% or smaller.

As to the pressurizing members 21 shown in FIGS. 17 and 18, a large hardness of the edge portions B led to the uniform nip width so that the occurrence of cold offset could be prevented. In other words, the pressurizing member 21 can be prevented from stretching in the thrust direction due to the pressure applied thereto, and thus, the uniform nip width can be assured. For this reason, cold offset can be prevented from occurring at the edge portions B when paper sheets are continuously caused to pass through the nip portion. The volume of the pressurizing member 21 and the total volume of the edge portions B that serves as an insulating layer to the volume of the entire pressurizing member 21 are set appropriate. Accordingly, the edge portions B can be prevented from locally deforming and the uniform nip width can be assured. Hence, the cold offset can be prevented from occurring at the edge portions B. In addition, the thicknesses of the edge portions B can be larger than that of the central portion A to realize an appropriate amount of elastic deformation of the pressurizing member 21.

Furthermore, an elastic member that has a small thermal expansion coefficient can be used as the edge portions B so that the edge portions B serves as an insulating layer and stoppers that prevents the central portion A from stretching in the thrust direction. The application of the coating agent C to the surface of the pressurizing member 21 makes larger the thicknesses of the edge portions B than that of the central portion A, and thus, the uniform nip width can be assured. The hardness of the edge portions B that is larger than the hardness of the central portion A realizes an appropriate amount of elastic deformation of the pressurizing member 21. It is preferable that the pressurizing member 21 deform appropriately to assure a uniform nip width, by, for example, making appropriate hardness and the thicknesses of the central portion A and the edge portions B and the permanent deformations of the central portion A and the edge portions B. The use of a pressurizing belt instead of the pressurizing member can realize high-speed printing.

Figure 19:
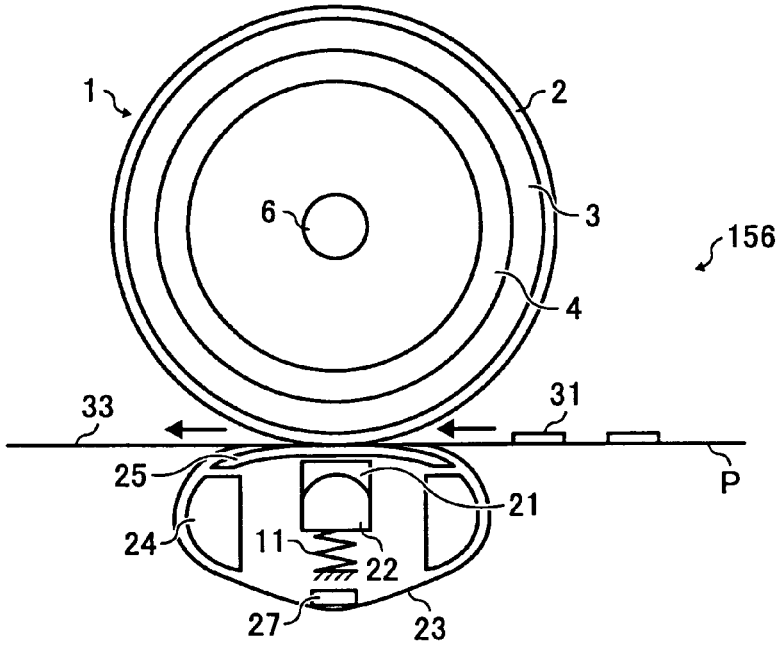
FIG. 19 is a schematic diagram of a fixing device according to a first example of a fifth embodiment of the fixing device shown in FIG. 1.

FIG. 19 is a schematic diagram of a fixing device 156 according to a first example of a fifth embodiment of the fixing device shown in FIG. 1. The same reference numerals as those of the fixing device 116 shown in FIG. 2 are given to the members of the fixing device 156 shown in FIG. 19 that have the same functions.

The surface of the pressurizing member 21 is flat, and the supporting member 22 has a round portion along the sheet direction. An elastic member of the pressurizing member 21 that has a flat surface and a supporting member 22 whose center portion is a convex portion realizes an elastic coefficient of the elastic-member center portion higher than elastic coefficients of the elastic-member entering portion and the elastic-member exit portion. The coefficient is K=EA/t, where E is a Young's modulus, A is an area of the nip portion, and t is a thickness of the elastic member in the direction of application of load. The lubricant-supplying member 27 supplies a lubricant for further reducing friction between the endless member 23 and the pressurizing member 21. As a lubricant of the lubricant-supplying member 27, one containing silicon oil or fluorine oil is generally used. The fixed image 33 is obtained after the paper sheet P passes through a nip portion formed between the heating-fixing roller 1 and the endless member 23. As the surface-covering layer 2, for example, a PFA layer is used to prevent the unfixed toner 31 to be adhered to the heating-fixing roller 1. As the elastic layer 3, for instance, silicon rubber or fluororubber is generally used. When silicon rubber is used, the elastic layer 3 may be coated with, for example, a fluorine layer or the like to improve swelling resistance. The endless member 23 is made of PFA and polyimide. As the pressurizing member 21, a pressurizing pad with the flat surface to which a pressure is applied is used. The pressurizing member 21 includes an elastic member formed of silicon rubber or fluorine rubber. As the paper sheet P, any type of recording medium such as a cut sheet can be used.

Figure 20:
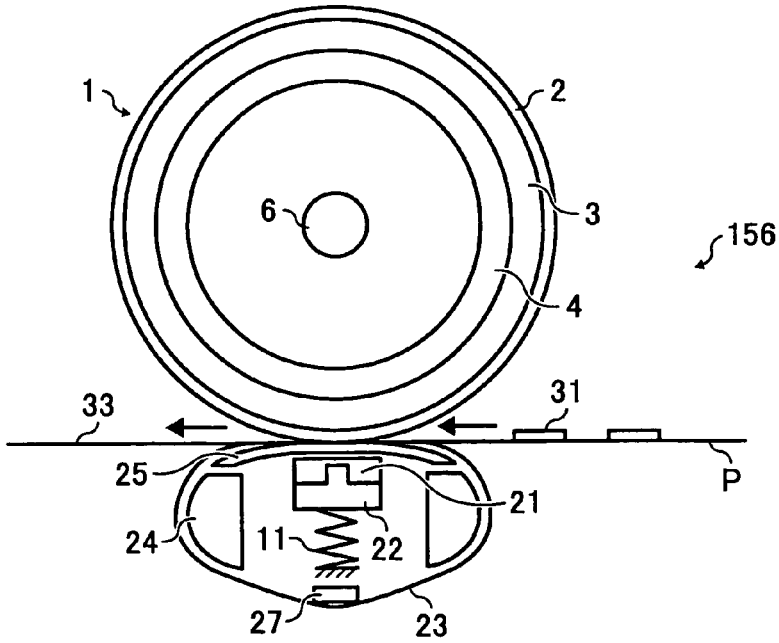
FIG. 20 is a schematic diagram of a fixing device according to a second example of the fifth embodiment.

FIG. 20 is a schematic diagram of the fixing device 156 according to a second example of the fifth embodiment. The surface of the pressurizing member 21 is flat, and the supporting member 22 has a step-shaped portion. Except for the above point, the fixing device 156 shown in FIG. 20 has the same structure as that of the fixing device 116 shown in FIG. 2.

Figure 21:
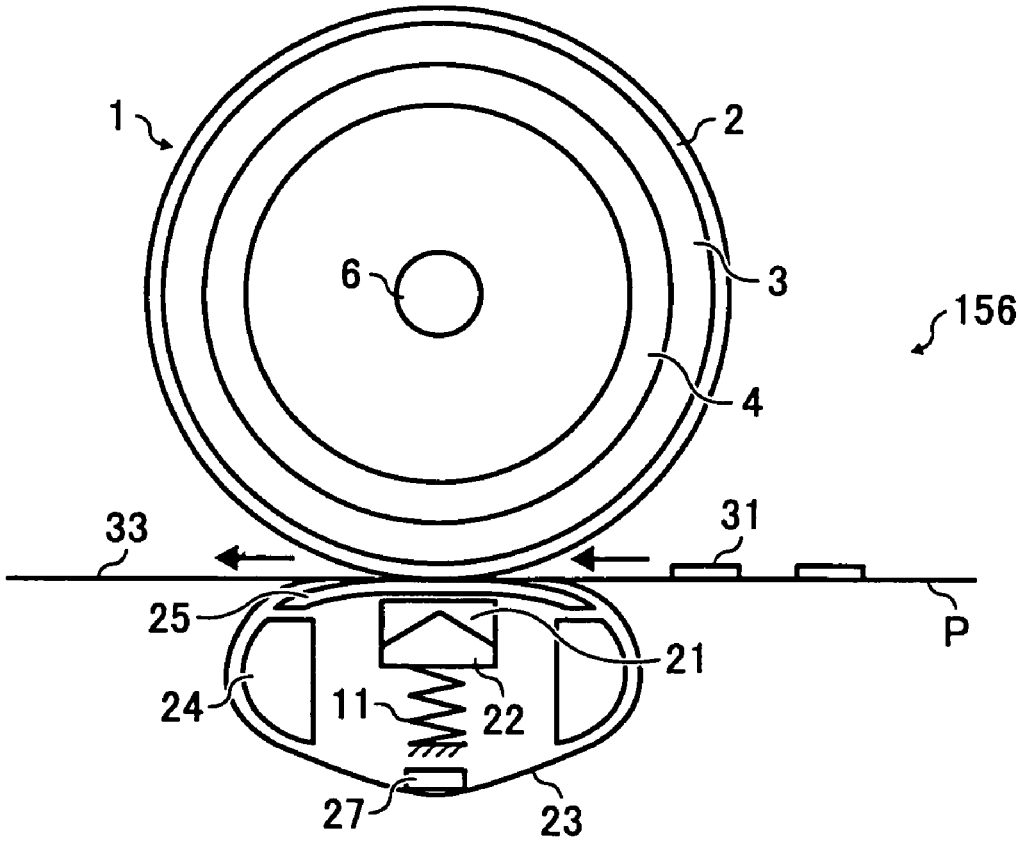
FIG. 21 is a schematic diagram of a fixing device according to a third example of the fifth embodiment.

FIG. 21 is a schematic diagram of the fixing device 156 according to a third example of the fifth embodiment. The surface of the pressurizing member 21 is flat, and the supporting member 22 has an inverted V-shaped portion. Except for the above point, the fixing device 156 shown in FIG. 21 has the same structure as that of the fixing device 116 shown in FIG. 2.

The pressure distribution obtained when the pressurizing member 21 is pressed against the heating-fixing roller 1 in each of the types shown in FIGS. 19 to 21 is same as that shown in FIG. 6. Hence, the same explanation is omitted below.

Examples of deformation of the elastic layer 3 of the heating-fixing roller 1 of the fixing device 156 in the sheet direction are same as those shown in FIG. 7. Thus, the same explanation is omitted below.

Figure 22:
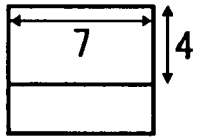
FIG. 22 is a table containing the results of evaluation tests on the fixing devices shown in FIGS. 19 to 21.
Figure 22:
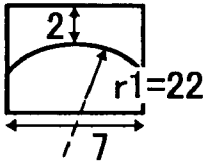
Figure 22:
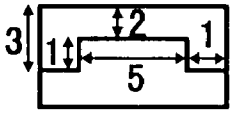
Figure 22:
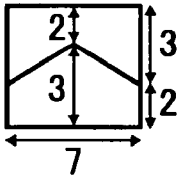
Figure 24:
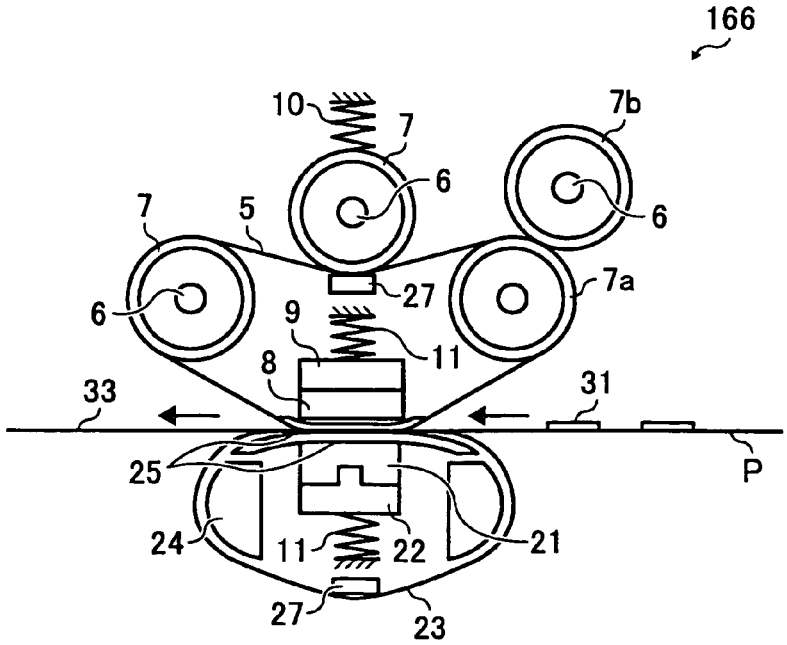
FIG. 24 is a schematic diagram of a fixing device according to a second example of the sixth embodiment.

FIG. 22 is a table containing the results of the evaluation tests on the sheet releasability, using fixing devices 156 shown in FIGS. 19 to 21, each fixing device including a heating-fixing roller made by SWCC Showa Cable Systems Co., Ltd. The heating-fixing roller had an outer diameter of ϕ27 mm. The heating-fixing roller included an elastic layer having a thickness of 1.0 mm, a hardness of 8 Hs (JIS-A), a permanent deformation of 4%, and a length in an axial direction of 230 mm. Each of the fixing devices included a pressurizing unit, and the structures of the pressurizing units were different from one another, and a load of 40 kgf was applied to each of the fixing units for the evaluation tests. The same conditions including a certain nip width were applied to each of the evaluation tests. Note that a nip width shown in FIG. 24 is a reference value.

In the evaluation tests, a full-color image was formed and fixed on a generally-used cut paper sheet with a basis weight of 55 g/cm$^2$. As a result of the evaluation tests, it was found that the pressurizing pads of the pressurizing members having the respective shapes shown in FIGS. 19 to 21 improve the sheet releasability as shown in FIG. 7 compared with the pressurizing member 21 that has a thickness in the load application direction of 4 mm and includes an elastic member with a hardness of 8 Hs (JIS-A) and a permanent deformation of 4% and. The sheet releasability improves because the elastic layer of the heating-fixing roller 1 deforms appropriately depending on the appropriate differences between the elastic moduli of the elastic-member entering portion and the elastic-member center portion of the pressurizing member and between the elastic moduli of the elastic-member exit portion and the elastic-member center portion thereof so that a convex portion is formed. The differences are equal to a value larger than a certain value. If the permanent deformation of the elastic layer 3 of the heating-fixing roller 1 is large, image deterioration, such as uneven gloss of an image may be caused.

The results of the evaluation tests indicated that a permanent deformation equal to 5% or larger increases the amount of uneven gloss of an image, and that a permanent deformation equal to 4% or smaller is desirable. Based on the idea that a large clearance between the surface of the heating-fixing roller and the sheet surface improves the sheet releasability, the outer surface of the heating-fixing roller is also a parameter for defining the clearance. The results also indicated that an outer diameter equal to ϕ27 mm or larger lowers the sheet releasability. Hence, it is desirable that the heating-fixing roller 1 have an outer diameter equal to ϕ27 mm or smaller.

The test results also indicated that the thickness of the elastic layer 3 of the heating-fixing roller 1 is a parameter for defining the clearance. It was found that a thickness of the elastic layer 3 equal to 0.8 mm or smaller lowers the sheet releasability because a small thickness of the elastic layer leads to a small amount of deformation of the elastic layer so that the paper sheet cannot be in an appropriate state at the nip exit. For this reason, it is desirable that the elastic layer 3 have a thickness equal to 0.8 mm or more.

The test results also indicated that the hardness of the elastic layer 3 of the heating-fixing roller 1 is a parameter for defining the clearance. It was found that the hardness of the elastic layer 3 equal to 8 Hs (JIS-A) or larger lowers the sheet releasability. The sheet releasability is lowered because a large hardness of the elastic layer 3 leads to a small amount of the deformation of the elastic layer so that the sheet cannot be in an appropriate state at the nip exit. For this reason, it is desirable that the elastic layer 3 have a hardness of 8 Hs (JIS-A) or smaller.

A large permanent deformation of the pressuring member 21 may cause a temporal change of the nip shape so that the fixing characteristics of toner to the sheet and the sheet releasability are unstable. The results of the evaluation tests indicated that a permanent deformation equal to 5% or larger lowers the sheet releasability after the heating-fixing roller was heated and rotated for 100 hours or more. For this reason, it is desirable that the pressurizing member have a permanent deformation of 4% or smaller.

Figure 23:
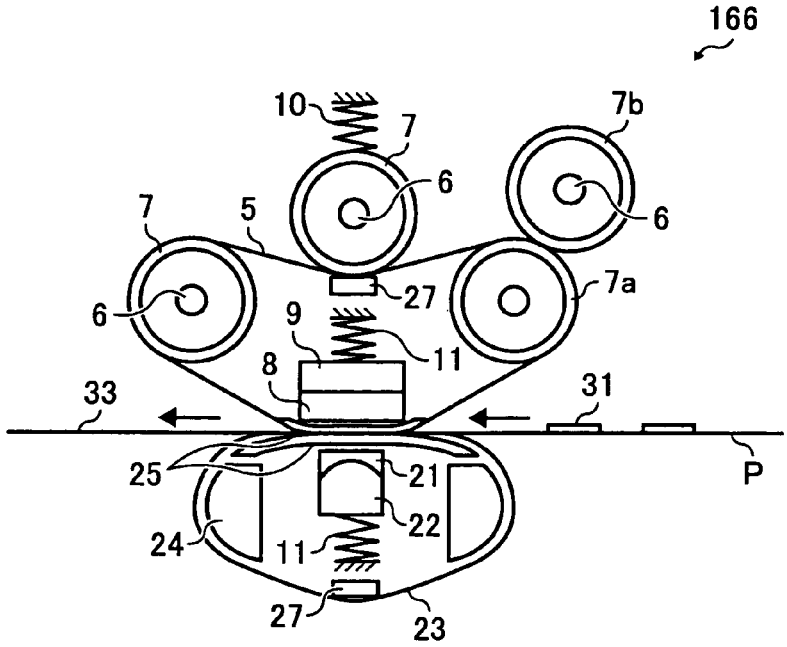
FIG. 23 is a schematic diagram of a fixing device according to a first example of a sixth embodiment of the fixing device shown in FIG. 1.

FIG. 23 is a schematic of a fixing device 166 according to a first example of a sixth embodiment of the present invention. The same reference numerals of other embodiments are given to members of the fixing device 166 that are same as or similar to those of other embodiments. The fixing device 166 includes the endless heating member 5 that faces the surface of a paper sheet P with a toner image thereon, the heating member 8 that includes an elastic layer, a pressurizing-supporting member 9 that supports the heating member 8, the heat source 6, and heating rollers 7 across which the endless heating member 5 extends. The heating rollers can be configured to heat the endless heating member 5. If heat applied to the endless heating member 5 is insufficient, the heating roller 7 can be caused to be in contact with the outer surface of the endless heating member 5 to heat the endless heating member 5.

The driven roller 7*a* has no heat source and is driven to rotate. Each of the heating rollers 7 has a drive source to drive the endless heating member 5. Alternatively, the driven roller 7*a* can have a drive source. The use of the endless heating member 5 instead of the heating-fixing roller 1 allows adjustment of the nip width and the deformation of the endless heating member 5 on a side from which the paper sheet S exits from a nip portion with little change of the size of the fixing device 126. Each of the pressurizing member 21 and the supporting member 22 has a round portion. In this structure, the width of the pressurizing member 21 needs to be equal to or smaller than the width of the heating member 8.

FIG. 24 is a schematic diagram of the fixing device 166 according to a second example of the sixth embodiment. The surface of the pressurizing member 21 is flat, and the supporting member 22 has a step-shaped portion. Except for the above point, the fixing device 166 has the almost same structure as that of the fixing device 166 shown in FIG. 23.

Figure 25:
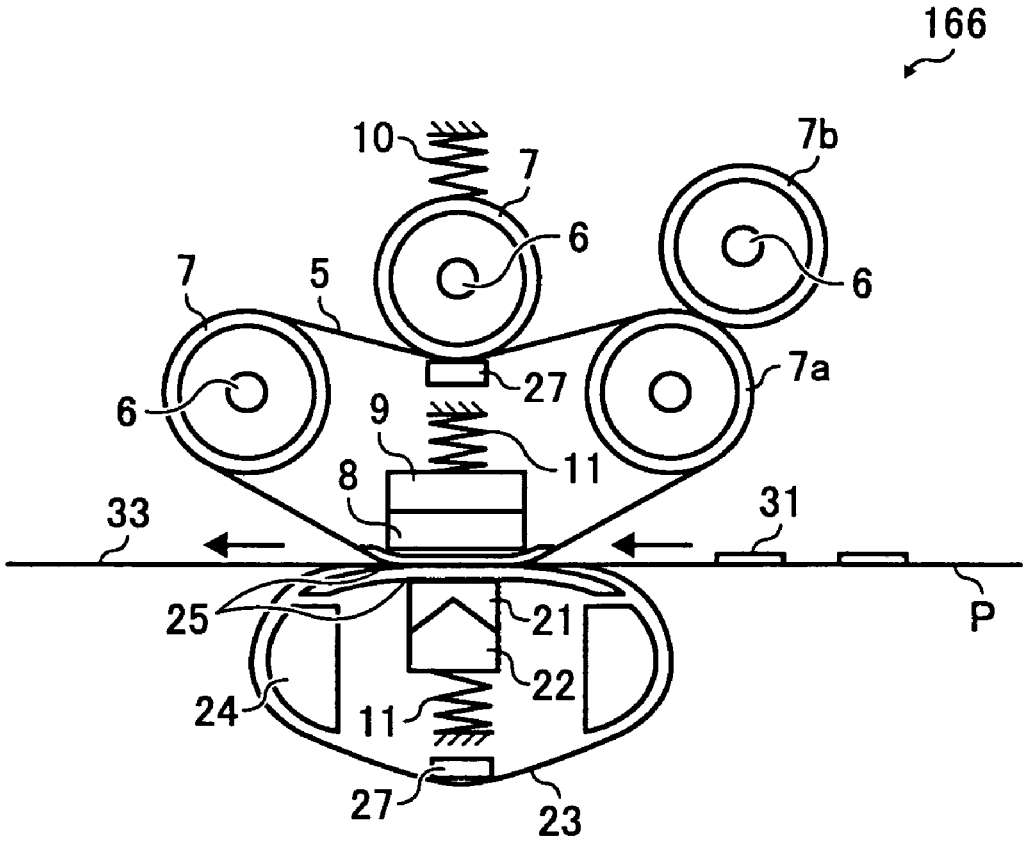
FIG. 25 is a schematic diagram of a fixing device according to a third example of the fifth embodiment.

FIG. 25 is a schematic diagram of the fixing device 166 according to a second example of the sixth embodiment. The surface of the pressurizing member 21 is flat, and the supporting member 22 has an inverted V-shaped portion. Except for the above point, the fixing device 166 has the almost same structure as that of the fixing device 166 shown in FIG. 23.

The elastic member of the pressurizing member 21 according to the fifth and sixth embodiments has the elastic-layer center portion having an elastic modulus that is higher than elastic moduli of an elastic-layer entering portion and an elastic-layer entering portion. The elastic modulus is $K=EA/t$, where E is a Young's modulus, A is an area of a nip portion, and t is a thickness of the elastic member in the load application direction. In addition, the supporting member 22 has the center portion having a thickness in the load application direction larger than those of the entering portion and the exit portion, and thus, the supporting member 22 has a convex portion. Accordingly, the elastic layer of the heating-fixing roller locally deforms so that the sheet can be in an appropriate state at the nip exit. This reduces the amount of the shift of an image on a recording medium and a load applied to the recording medium, and the sheet releasability improves effectively.

In addition, the width of the elastic member according to the fifth and sixth embodiments is made appropriate so that the elastic layer of the heating-fixing roller deforms. Accordingly, the sheet can be in an appropriate state at the nip exit. This reduces the amount of the shift of an image on a recording medium and a load applied to the recording medium, and the sheet releasability improves effectively. As described, the convex portion of the supporting member 22 can be a step-shaped portion, a round portion, or an inverted V-shaped portion. The use of the heating roller realizes the entire image forming apparatus at a low cost.

The heating-fixing roller according to the fifth and sixth embodiments can have a diameter equal to $\phi 27$ mm or smaller, and an elastic layer with a hardness equal to 8 Hs (JIS-A) or smaller and a thickness equal to 0.8 mm or larger.

The elastic layer of the heating-fixing roller according to the fifth and sixth embodiments can have a permanent deformation equal to 4% or smaller.

The use of the heating belt according to the fifth and sixth embodiments realizes high-speed fixing.

The use of the fixing devices according to the fifth and sixth embodiments in an image forming apparatus makes the overall structure of the image forming apparatus simple. In addition, the fixing devices improve the releasability of the recording medium from the heating unit without application of a heavy load to the recording medium, thereby improving the quality of an image formed on the recording medium.

As described above, according to an aspect of the present invention, an amount of the shift of an image on a recording medium is reduced, a load applied to the recording medium is reduced, and sheet releasability improves effectively.

Furthermore, according to another aspect of the present invention, the sheet releasability and the image quality improves depending on a method of forming an image in the above manner.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device comprising: a heating unit; an endless member arranged with the heating unit to form a nip portion therebetween; a pressurizing unit including a pressurizing member and a supporting member supporting the pressurizing member, the pressurizing member including an elastic member and the supporting member including an entering portion on an entering side from where a recording medium enters the nip portion, an exit portion on an exit side from where the recording medium exits the nip portion, and a center portion between the entering portion and the exit portion, a thickness of the center portion in a direction of an application of a load being larger than a thickness of the entering portion and a thickness of the exit portion in the direction of the application of the load so that the supporting member has a convex portion; a friction-reducing member between the pressurizing unit and the endless member, the friction-reducing member configured to reduce friction between the pressurizing unit and the endless member; and a pressurizing spring configured to press the pressurizing member and the supporting member against the recording medium, wherein the fixing device is configured to fix an unfixed toner image on the recording medium by applying heat from the heating unit and pressure from the pressurizing unit to the unfixed toner image on the recording medium located in the nip portion between the heating unit and the pressurizing unit.

2. The fixing device according to claim 1, wherein a width of the pressurizing member in a direction in which the recording medium is conveyed is equal to or narrower than a width of the nip portion obtained by pressing the pressurizing unit against the heating unit with a plate.

3. The fixing device according to claim 1, wherein the convex portion is step-shaped.

4. The fixing device according to claim 1, wherein the convex portion is curved.

5. The fixing device according to claim 1, wherein the convex portion is inverted V-shaped.

6. The fixing device according to claim 1, wherein the heating unit is a heating-fixing roller that includes an elastic layer and a heat core that are positioned inside the heating-fixing roller.

7. The fixing device according to claim 1, wherein the heating unit includes an elastic layer, a heat core, a plurality of rollers, each roller being configured to rotate, and an endless heating member configured to be wound around the rollers.

8. The fixing device according to claim 1, wherein the heating unit has an inverted-crown shape, in which a thickness of the heating unit in a vertical direction gradually decreases from each of two edges to center of the heating unit, the pressurizing unit has a crown shape, in which a thickness of the pressurizing unit in a vertical direction gradually increases from each of two edges to center of the pressurizing unit, the pressurizing unit has a pressurizing-unit center portion to be pressed against the heating unit such that that the crown shape fits the inverted-crown shape, and the elastic member has two edge portions and a central portion between the edge portions in a thrust direction of the pressurizing member, each edge portion having a hardness larger than a hardness of the central portion.

9. The fixing device according to claim 8, wherein the heating unit is a heating-fixing roller that includes an elastic layer and a heat core that are positioned inside the heating-fixing roller.

10. The fixing device according to claim 8, wherein the heating unit includes an elastic layer, a heat core, a plurality of rollers, each roller being configured to rotate, and an endless heating member configured to be wound around the rollers.

11. The fixing device according to claim 1, wherein the elastic member has an elastic-member entering portion on the entering side, an elastic-member exit portion on the exit side, and an elastic-member center portion between the elastic-member entering portion and the elastic-member exit portion, and the elastic-member center portion has a stiffness that is larger than a stiffness of the elastic-member entering portion and a stiffness of the elastic-member exit portion so that the supporting member has a convex portion.

12. The fixing device according to claim 11, wherein a width of the pressurizing member in a direction in which the recording medium is conveyed is equal to or narrower than a width of the nip portion obtained by pressing the pressurizing unit against the heating unit with a plate.

13. The fixing device according to claim 11, wherein the elastic member has an elastic-member entering portion on the entering side, an elastic-member exit portion on the exit side, and an elastic-member center portion between the elastic-member entering portion and the elastic-member exit portion, and the elastic-member center portion has the elastic modulus of K=EA/t that is larger than elastic moduli of the elastic-member entering portion and the elastic-member exit portion so that the supporting member has a step-shaped portion.

14. The fixing device according to claim 11, wherein the elastic member has an elastic-member entering portion on the entering side, an elastic-member exit portion on the exit side, and an elastic-member center portion between the elastic-member entering portion and the elastic-member exit portion, and the elastic-member center portion has a stiffness that is larger than a stiffness of the elastic-member entering portion and the elastic-member exit portion so that the supporting member has a curved portion.

15. The fixing device according to claim 11, wherein the elastic member has an elastic-member entering portion on the entering side, an elastic-member exit portion on the exit side, and an elastic-member center portion between the elastic-member entering portion and the elastic-member exit portion, and the elastic-member center portion has the elastic modulus of K-EA/t that is larger than elastic moduli of the elastic-member entering portion and the elastic-member exit portion so that the supporting member has an inverted V-shaped portion.

16. The fixing device according to claim 11, wherein the heating unit is a heating-fixing roller that includes an elastic layer and a heat core that are positioned inside the heating-fixing roller.

17. The fixing device according to claim 11, wherein the heating unit includes an elastic layer, a heat core, a plurality of rollers, each roller being configured to rotate, and an endless heating member configured to be wound around the rollers.

18. An image forming apparatus comprising:

a plurality of developing units for forming toner images of colors different from each other;

a photoreceptor that has a surface to which the toner images are transferred;

an intermediate transfer unit for transferring a transferred toner images on the photoreceptor thereto;

a transfer unit that transfers the transferred toner image on the intermediate transfer unit to a recording medium; and a fixing unit including a heating unit;

an endless member arranged with the heating unit to form a nip portion therebetween;

and a pressurizing unit that includes a pressurizing member and a supporting member supporting the pressurizing member the pressurizing member including an elastic member and the supporting member including an entering portion on an entering side from where the recording medium enters the nip portion, an exit portion on an exit side from where the recording medium exits the nip portion, and a center portion between the entering portion and the exit portion, a thickness of the center portion in the direction of an application of a load being larger than a thicknesses of the entering portion and a thickness of the exit portion in the direction of application of the load so that the supporting member has a convex portion;

a friction-reducing member between the pressurizing unit and the endless member, the friction-reducing member configured to reduce friction between the pressurizing unit and the endless member;

the fixing unit further including a pressurizing spring configured to press the pressurizing member and the supporting member against the recording medium, the fixing device is configured to fix an unfixed toner image on the recording medium by applying heat from the heating unit and pressure from the pressurizing unit to the unfixed toner image on the recording medium located in the nip portion between the heating unit and the pressurizing unit, wherein the fixing unit is configured to fix an unfixed toner image on the recording medium by applying heat from the heating unit and pressure with the pressurizing unit to the unfixed toner image on the recording medium located in the nip portion between the heating unit and the pressurizing unit.

19. The image forming apparatus according to claim 18, wherein the heating unit has an inverted-crown shape, in which a thickness of the heating unit in a vertical direction gradually decreases from each of two edges to center of the heating unit, the pressurizing unit has a crown shape, in which a thickness of the pressurizing unit in a vertical direction gradually increases from each of two edges to center of the pressurizing unit, the pressurizing unit has a pressurizing-unit center portion to be pressed against the heating unit such that that the crown shape fits the inverted-crown shape, and the elastic member has two edge portions and a central portion between the edge portions in a thrust direction of the pressurizing member, each edge portion having a hardness larger than a hardness of the central portion.

20. The image forming apparatus according to claim 18, wherein the elastic member has an elastic-member entering portion on the entering side, an elastic-member exit portion on the exit side, and an elastic-member center portion between the elastic-member entering portion and the elastic-member exit portion, and the elastic-member center portion has a stiffness that is larger than a stiffness of the elastic-member entering portion and the elastic-member exit portion so that the supporting member has a convex portion.

* * * * *